United States Patent [19]

Eisenhardt et al.

[11] 4,059,509

[45] Nov. 22, 1977

[54] PHOSPHATE ORE FLOTATION

[75] Inventors: Frank B. Eisenhardt; Stanislaus F. Muehlberger, both of Lakeland, Fla.

[73] Assignee: Mobil Oil Corporation, New York, N.Y.

[21] Appl. No.: 647,959

[22] Filed: Jan. 9, 1976

[51] Int. Cl.[2] ..... B03D 1/02
[52] U.S. Cl. ..... 209/166
[58] Field of Search ..... 209/166, 167

[56] References Cited

U.S. PATENT DOCUMENTS

| | | | |
|---|---|---|---|
| 2,293,640 | 8/1942 | Crugo | 209/166 |
| 2,313,360 | 3/1943 | Ralston | 209/166 |
| 2,461,817 | 2/1949 | Greene | 209/166 |
| 2,599,530 | 6/1952 | Hodges | 209/166 |
| 3,259,242 | 7/1966 | Snow | 209/166 |
| 3,454,159 | 7/1969 | Hollingsworth | 209/3 |

*Primary Examiner*—Robert Halper
*Attorney, Agent, or Firm*—Charles A. Huggett; Raymond W. Barclay; Claude E. Setliff

[57] ABSTRACT

The washing step that usually follows the deoiling of phosphate rougher concentrate is eliminated by adding lime to said rougher concentrate following the deoiling.

3 Claims, No Drawings

PHOSPHATE ORE FLOTATION

BACKGROUND OF THE INVENTION

1. Field of the Invention

The invention relates to the beneficiation of phosphate ores, and especially to an improvement that allows flotation of deoiled rougher concentrate in the amine circuit without prior washing.

2. Discussion of the Prior Art

Flotation is exclusively used in the concentration of phosphate ores, and given the very great differences in the various properties of the important constituents, flotation gives definite advantages over other types of separation.

Beneficiation of phosphate ores by flotation, as with other ores, is primarily concerned with the separation of one mineral from another by floating one away and leaving the other suspended in the water. This is made possible by selective use of organic or inorganic reagents which will render one or more of the ore constituents nonwettable, thereby allowing it to be held at the water surface by surface tension forces.

In the present system of phosphate rock flotation, the final grade of concentrate is achieved through a two-stage separation. Following the removal of slimes and other components that can be removed in the initial washing, the phosphate rock is treated, for example, with a fatty acid-fuel oil reagent system in an alkali solution. The float from this stage, the rougher concentrate, is normally de-oiled, washed and treated with amine and kerosene for a second float. The product has a resulting final concentrate (sink) grade of 72–78% bone phosphate of line (BPL).

Until now, there has been an unavoidable need to wash the deoiled rougher concentrate prior to the amine float. The present invention eliminates this need.

SUMMARY OF THE INVENTION

In accordance with the invention, there is provided an improved process for the recovery of phosphate rock from an aqueous suspension of solids, the process comprising at least two flotation steps employing the appropriate reagent systems, one of which is a fatty acid flotation and the other an amine floation, the improvement whereby the rougher concentrate from the fatty acid flotation is deoiled with a strong mineral acid, e.g. sulfuric acid treated with lime to neutralize the strong acid and refloated to recover the phosphate values present without washing following addition of said lime.

DESCRIPTION OF SPECIFIC EMBODIMENTS

In the presently used flotation process, the fatty acid and fuel oil from the rougher flotation has to be removed before the rougher concentrate can be treated with amine. This is usually done with sulfuric acid, which is itself subsequently removed by passing the deoiled rougher concentrate through "vee" boxes or similar washing boxes. Water is passed up through a descending stream of concentrate to remove the sulfuric acid and hydrocarbons and to bring the pH to about 7.0.

So far as is known, there is no acceptable prior art process for effectively removing fatty acid from a rougher concentrate not involving the wash step mentioned. An acceptable new process is needed, however, because in many cases, the loss of fine material in the concentrate cannot be prevented in the present process because of the low terminal velocities of the fine particles and because of variations in ascending water velocities.

The present improvement fits well into the usual flotation scheme, and eliminates one expensive step, thus contribution to economy of time, money and natural resources, especially water. The process, in general terms, begins with removal of phosphate rock from mines, as from strip mines in Florida. The phosphate rock is washed into a pit where it is slurried with water and piped to the processing plant. Here, the matrix slurry is put through a series of screens, log washers, cyclones, sizers and classifiers to separate it according to size and to remove slimes. The flotation feed is introduced into a feed conditioner where fatty acid, or other organic compounds, a petroleum fraction and caustic are blended in.

The fatty acid may be any acid normally used in phosphate ore beneficiation. Usually this is an oleic acid ($C_{18}$) or a mixture of fatty acids of the $C_{18}$ molecular weight range.

The acid flotation produces a so-called rougher concentrate, which is passed through a deoiling section where the concentrate is treated with sulfuric acid to remove fatty acid and fuel oil. It is then treated with lime, reagentized with an amine and a petroleum fraction and refloated to remove the silica that floated with the apatite in the first stage.

The petroleum fraction useful in phosphate flotation processes can be any of a number of products normally used in the phosphate flotation industry. These include kerosene, or range oil, and the distillate fuel oils, including Nos. 1 through 6. Further, the term "petroleum fraction" includes those whose properties are described on pages 11–41 through 11–56 of the Petroleum Processing Handbook, McGraw-Hill Book Company (1967).

The amines generally used are derived from the middle range fatty acids, i.e. in the range of about 12 – 18 carbon atoms. These are obtained from animal, vegetable and tall oil fatty acids which have been condensed with, for example, ethanolamine or primary fatty amines and are generally neutralized with, for example, acetic acid. Others that may be used are described in U.S. Pat. No. 3,388,793.

The lime useful in the practice of this invention may be purchased in the form of CaO (as lime or quicklime) or as a solution-suspension of $Ca(OH)_2$. In general, the lime is effective in amounts, in pounds per ton of ore, of from about 0.1 to about 2.0.

Having described the invention in general terms, the following are offered to further illustrate the invention. It will be understood that they are illustrative only and are not to unnecessarily limit the invention.

EXAMPLE 1

A phosphate ore was conditioned and run through a fatty acid float using the above-described fatty acid, fuel oil and caustic. The rougher concentrate obtained was deoiled with sulfuric acid, the supernatant liquid was decanted and the concentrate was neutralized with lime ($Ca(OH)_2$), using 1.6 pounds per ton of amine feed. This neutralized concentrate was, without washing, treated with 0.625 pound per ton of feed of amine and 0.86 pound per ton of feed of kerosene and floated. Following are the results:

Metallurgy
Amine Feed, BPL: 63.0

Concentrate, BPL: 76.4
Tailings, BPL: 11.6
Yield, weight %: 80.5
BPL Recovery, %: 96.4

The invention has been illustrated with a process in which the rougher concentrate (from the acid float) is deoiled with sulfuric acid, reacted with lime and floated in an amine circuit without washing between the sulfuric acid deoiling and lime treat. It will be understood that except for the step of treating the lime and the absence of the usual deoiling wash step, no step or reagent is absolutely fixed. Other reagents and other or different steps that would normally occur to one of skill in this art and that will not effect the beneficial recovery of phosphate ore may be used.

We claim:

1. An improved process for the recovery of phosphate rock from an aqueous suspension of solids, the process comprising at least two flotation steps employing the appropriate reagent system, one of which is fatty acid flotation and the other an amine flotation, the improvement whereby the rougher concentrate from the fatty acid flotation is deoiled with a strong mineral acid, treated with lime to neutralize the strong acid, reagentized with an amine and refloated to recover the phosphate values present without washing following deoiling and addition of said lime.

2. The process of claim 1 wherein the lime is $Ca(OH)_2$.

3. The process of claim 1 wherein the lime is used in an amount to adjust the pH of the deoiled rougher concentrate to from about 3 to about 7.5.

* * * * *